US006444102B1

(12) United States Patent
Tucci et al.

(10) Patent No.: US 6,444,102 B1
(45) Date of Patent: Sep. 3, 2002

(54) CARBON FIBER ELECTRICAL CONTACTS

(75) Inventors: Michael Tucci, New York City; Philip Uruburu, Central Islip; Stephen Veselaski, Bay Shore, all of NY (US)

(73) Assignee: Micro Contacts Inc., Hicksville, NY (US)

( * ) Notice: Subject to any disclaimer, the term of this patent is extended or adjusted under 35 U.S.C. 154(b) by 0 days.

(21) Appl. No.: 09/498,872

(22) Filed: Feb. 7, 2000

(51) Int. Cl.[7] ..... C25B 9/00

(52) U.S. Cl. ..... 204/279; 200/252; 200/262; 200/275; 439/87

(58) Field of Search ..... 204/224 R, 279, 204/280, 294; 439/86–87; 200/275, 252, 262

(56) References Cited

U.S. PATENT DOCUMENTS

| | | | | | |
|---|---|---|---|---|---|
| 3,619,382 | A | * | 11/1971 | Lupinsky | 204/224 R X |
| 3,668,451 | A | | 6/1972 | McNab | 310/248 |
| 3,818,588 | A | | 6/1974 | Bates | 29/630 E |
| 3,821,024 | A | | 6/1974 | Wilkin et al. | 117/217 |
| 4,358,699 | A | | 11/1982 | Wilsdorf | 310/251 |
| 4,415,635 | A | | 11/1983 | Wilsdorf et al. | 428/611 |
| 4,534,366 | A | * | 8/1985 | Soukup | 128/786 |
| 4,641,949 | A | | 2/1987 | Wallace et al. | 355/3 |
| 4,694,272 | A | | 9/1987 | Maisch | 338/138 |
| 4,728,755 | A | | 3/1988 | Fowler et al. | 200/11 DA |
| 4,732,802 | A | | 3/1988 | Bosze et al. | 428/210 |
| 4,762,603 | A | * | 8/1988 | Morin | 204/280 X |
| 4,855,024 | A | * | 8/1989 | Drachnik et al. | 204/279 X |
| 4,894,500 | A | | 1/1990 | Yamazaki et al. | 200/565 |
| 4,912,288 | A | | 3/1990 | Atkinson et al. | 174/251 |
| 4,967,314 | A | | 10/1990 | Higgins, III | 361/414 |
| 4,970,553 | A | | 11/1990 | Orlowski et al. | 355/200 |
| 5,003,693 | A | | 4/1991 | Atkinson et al. | 29/849 |
| 5,023,418 | A | | 6/1991 | Beckhausen | 200/511 |
| 5,072,080 | A | | 12/1991 | Beckhausen | 200/61.43 |
| 5,111,178 | A | | 5/1992 | Bosze | 338/160 |
| 5,117,529 | A | | 6/1992 | Ohta | 15/230 |
| 5,139,862 | A | | 8/1992 | Swift et al. | 428/294 |
| 5,155,306 | A | | 10/1992 | Iijima et al. | 200/11 |
| 5,177,529 | A | * | 1/1993 | Schroll et al. | 355/200 |
| 5,270,106 | A | | 12/1993 | Orlowski et al. | 428/295 |
| 5,282,310 | A | | 2/1994 | Rommelmann et al. | 29/825 |
| 5,420,465 | A | | 5/1995 | Wallace et al. | 307/116 |
| 5,780,793 | A | | 7/1998 | Buchholz et al. | 200/61.44 |
| 6,104,357 | A | * | 8/2000 | Brage | 343/867 |
| 6,140,907 | A | * | 10/2000 | Liu | 338/160 |

FOREIGN PATENT DOCUMENTS

| | | | |
|---|---|---|---|
| DE | 3532963 | 3/1987 | H01H/1/02 |
| DE | 9215176 | 2/1993 | H01H/13/16 |
| DE | 9213726 | 4/1993 | E05F/15/20 |
| DE | 4442617 | 6/1996 | H01R/41/100 |
| JP | 3133080 | 6/1991 | H01R/43/20 |

* cited by examiner

*Primary Examiner*—Donald R. Valentine
(74) *Attorney, Agent, or Firm*—Jay H. Maioli

(57) ABSTRACT

A nonmetallic electrical contact or wiper composed of material such as carbon fiber, in which an electrical signal is transmitted along a length of the carbon fibers. The carbon fibers can be fused or conductively bonded together. The carbon fibers can be affixed to a carrier using various bonding and fastening techniques. The carrier can be electrically conductive or not depending on the application and can be affixed to the carbon fibers by bonding, fusing, or mechanical fastening. Alternatively, the electrical contact can be formed entirely from the carbon fiber material, with any carrier being also formed of carbon fiber material.

23 Claims, 4 Drawing Sheets

1/4

10
12
26
14
16
28
18
20
30
22
24
80
82
84
86
88

CARBON FIBER ELECTRICAL CONTACTS

BACKGROUND OF THE INVENTION

1. Field of the Invention

This invention relates generally to an electrical contact or an electrical contact assembly typically used in an electromechanical device and, more particularly, to a contact or contact assembly that utilizes carbon fibers in various forms as the element that makes electrical contact with another element of the electromechanical device.

2. Description of Background

Variable resistive devices utilize elements that vary a voltage or current in order to provide an electrical signal that indicates a relationship to a physical position of a contact or wiper on a resistive or conductive element. Because these variable resistive devices are used in a dynamic state they can not be fixed or restricted in their movement and must have the freedom to be positioned along any length of their respective resistive or conductive paths. The contact or wiper must therefore be produced of a material that is electrically, physically, and environmentally compatible with the resistive and/or conductive track when in the presence of an electrically active and physically dynamic system. The contact or wiper must also provide a long useful life, while maintaining uniform positive engagement with the resistive or conductive element and not produce polymers or debris which acts as an insulator and distorts the output signal.

Presently the contact or wiper materials used for these variable resistive devices are composed of various clad or coated metals or precious metal alloys. These precious metal containing contacts in a dynamic state and in the presence of electrical activity act as catalysts to generate polymers and debris which degrade the resistive track output signals. This results in the early termination of accurate performance and useful life.

Initially metal contacts or wipers were used with wirewound resistive or metallic conductive elements, because wirewound elements were the most precise devices. As time evolved great improvements were made in the non-wirewound product area, and they supplanted the wirewound resistive element, but the contact or wiper has always created problems relative to the resistive element because in the presence of an electrical current and dynamic performance, the precious metal components of the metallic contact provide the catalyst to generate polymers and debris, which interfere with the accuracy of the output signal.

Now that reduction in size, improved accuracy, and a reduction in electrical contact resistance are required in modern servo feedback positioning systems, non-metallic contact materials must be considered to obtain the necessary and sorely needed improvements in these performance characteristics and elimination of the polymers and debris.

Accordingly, the need exists for improvements in electrical contacts and contact assemblies and, particularly, for improvements in the materials and assemblies employed therefor.

OBJECTS AND SUMMARY OF THE INVENTION

Accordingly, it is an object of the present invention to provide a contact or contact assembly for use in electromechanical applications that can effectively eliminate the above-noted defects inherent in previously proposed systems.

It is another object of this invention to eliminate the above-described negative conditions and characteristics of previously known systems and to improve considerably the useful life of the system by providing a contact or wiper formed of nonmetallic material, such as one composed of carbon fibers. This carbon fiber material, through special processing, not only overcomes the negative conditions caused by metal composition contacts or wipers, but considerably improves total performance in all other aspects.

It is a further object of the present invention to provide a wiper contact or contact assembly for use in electromechanical components or applications that is more compatible with present state of the art fabrication techniques and materials used for resistive and conductive track substrates and that appreciably reduces or eliminates the negative aspects inherent in presently used or previously proposed designs or materials.

In accordance with one aspect of the present invention an existing contact carrier is employed and in place of the previously used metal contacts, carbon fibers are employed that are specially attached to a carrier.

According to one aspect of the present invention, a nonmetallic electrical contact, such as one made of carbon fiber material, is processed and formed in such a manner as to allow the multiple strands of carbon fiber when properly positioned to be electrically conductive for transmitting umimpeded electrical signals along its longitudinal length. Such carbon fiber strands may be fused or conductively bonded by any of various techniques to provide essentially uniform conductivity and redundant transmission of the electrical signal. The carbon fiber material can be affixed to a carrier or the fibers may be utilized without a carrier. Such a carrier, if used, may be metallic or non-metallic and may be affixed to the carbon fiber bundles by any of various bonding, fusing, and fastening techniques. The carrier can also be electrically nonconductive, depending upon the application. Alternatively, the carrier can be formed of the same homogenous carbon fiber material as that used for the actual contact. Forming of the carbon fiber contact can involve cross-layering of the material in nonparallel orientations to provide additional structural integrity, as well as to assist in the postforming operation.

The inventive wiper contact is rigid enough to sustain and maintain a consistent position relative to its parallel alignment to the resistive or conductive track of the substrate element and yet is flexible enough in a perpendicular position to the track to allow some variation in movement to sustain uniform contact position, spring rate and pressure. Thus, the electrical output signal maintains its integrity.

A further aspect of the present invention is that the contact surface of the wiper contact that is adjacent to the resistive or conductive track is composed of multiple points of contact, rather than either a small number of metal fibers or just one broad band of a rigid beam contact. This ensures a more redundant positive footprint with the resistive or conductive track, which reduces contact resistance and variable electrical noise.

The above and other objects, features, and advantages of the present invention will become apparent from the following detailed description of illustrative embodiments thereof to be read in conjunction with the accompanying drawings.

DETAILED DESCRIPTION OF PREFERRED EMBODIMENTS

The present invention provides a contact or wiper element for transmitting electrical signals, either in a low voltage mode (under 15 volts) or a low current mode (under 500 ma), between a resistive and/or a conductive track and some external circuit termination. In one embodiment-the contact or wiper element comprises one or more thin, single layers of carbon fiber elements, all aligned in one direction bonded together and firmly fixed in a very low-resistance, synthetic resin compound for structural stability and electrical continuity.

Figures 1A, 1B, 1C, 1D, 2A, 2B, 2C, 7:
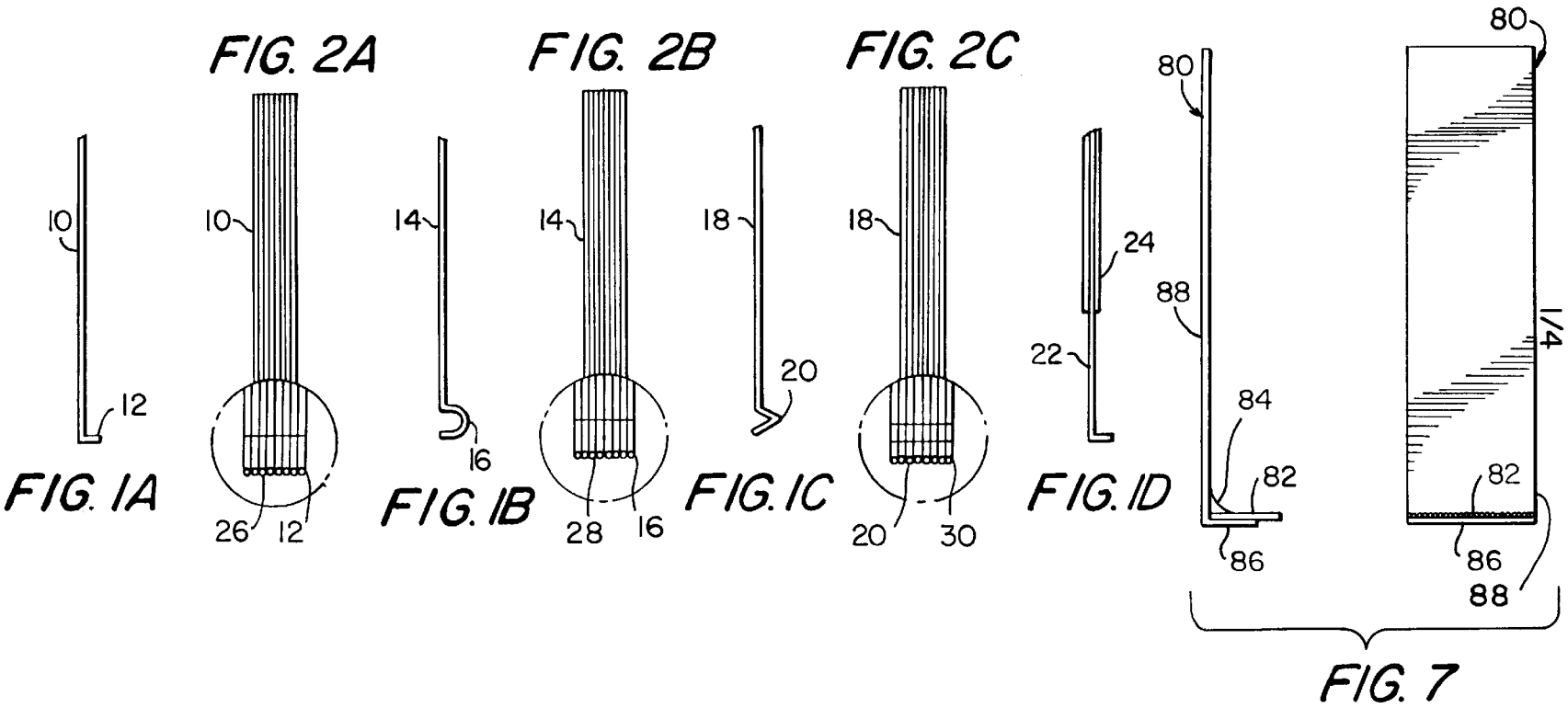
FIGS. 1A–1D are side elevations showing respective embodiments of electrical contacts according to the present invention.
FIGS. 2A–2C are front elevations and respective enlargements showing embodiments of electrical contacts corresponding to FIGS. 1A–1C, respectively.
FIG. 7 shows two views of a carbon fiber electrical contact affixed to an electrically conductive beam according to an embodiment of the present invention.

As shown in FIGS. 1A–1C, the ends of the contact or wiper may be specially formed to give the engagement portion of the contact or wiper added strength and permit better mating of the carbon fiber element to the track of the device. In FIG. 1A, the contact 10 has a rake end 12. In FIG. 1B, the contact 14 has a knuckle end 16. In FIG. 1C, the contact 18 has a pointed end 20.

The contact or wiper 22, as shown in FIG. ID, may also engage a mechanical strip 24 for support or for attachment purposes. The mechanical strip 24 may be electrically conductive or not, depending upon the desired application.

FIGS. 2A, 2B, and 2C correspond, respectively, to FIGS. 1A, 1B, and 1C and show the arrangement of the carbon fiber bundles forming the specialized end constructions 12, 16, and 20, respectively. That is, the enlargement of FIG. 2A shows carbon fiber bundles 26 arranged in one layer forming the rake end 12. Similarly, bundles 28 and 30 respectively form knuckle end 16 and pointed end 20 in FIGS. 2B and 2C, respectively.

Figure 3:
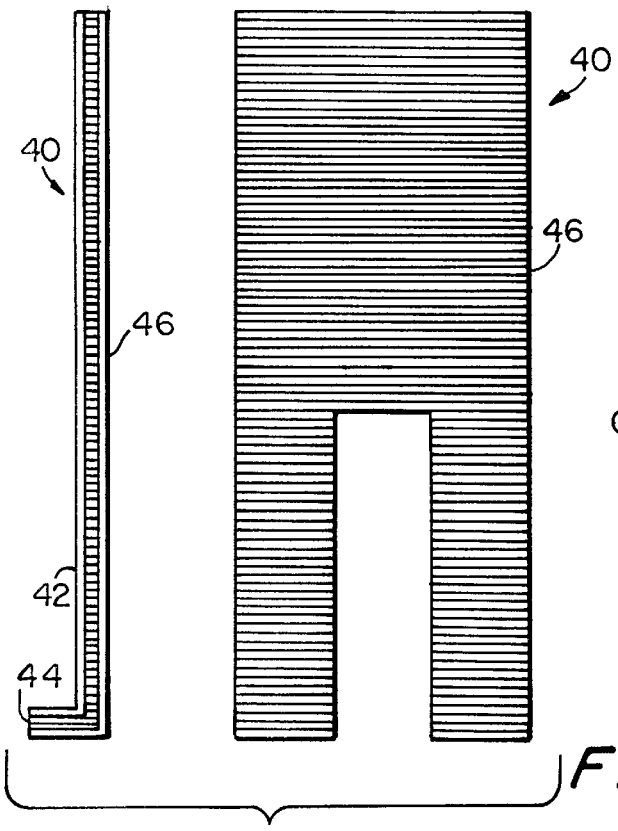
FIG. 3 shows two views of a carbon fiber contact formed as a matrix of layers of carbon fibers.

In the embodiment shown in FIG. 3, the contact or wiper element 40 is formed of a carbon fiber matrix, whose adjacent three carbon fiber layers 42,44,46 are essentially perpendicular to each other. The carbon fibers forming layers 42, 44, 46 are not bundled but are discretely placed in a cross-hatching matrix, wherein the fibers in alternate layers may be parallel to each other, but those inadjacent layers are essentially nonparallel and may be perpendicular to each other.

Figure 4:
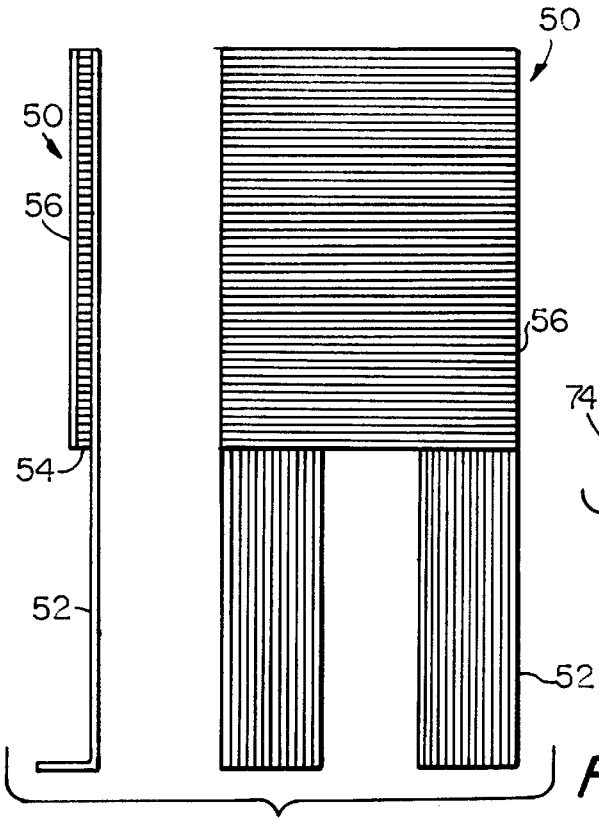
FIG. 4 shows two views of a carbon fiber contact formed as a matrix of layers of carbon fibers.

FIG. 4 shows a similarly constructed contact 50 in which the carbon fibers of only one layer 52 perform the actual contacting and an inner layer 54 and second outer layer provide structural support.

The matrix composition shown in the embodiments of FIGS. 3 and 4 reinforces and strengthens the minuscule carbon fiber strands to provide support for retaining stable contact position. The carbon fiber strands may be continuous or discontinuous and the matrix need not necessarily be homogeneous.

Corresponding to the structure shown in FIG. 1D, the matrix compositions of FIGS. 3 and 4 can use an additional mechanical support strip, which can be electrically conductive depending upon the desired application. The carbon fibers of the matrix composition show[008e] in FIGS. 3 and 4 are firmly fixed in a very low resistance synthetic resin compound to restrict movement, add structural stability, and provide multidirectional electrical continuity.

Figure 5:
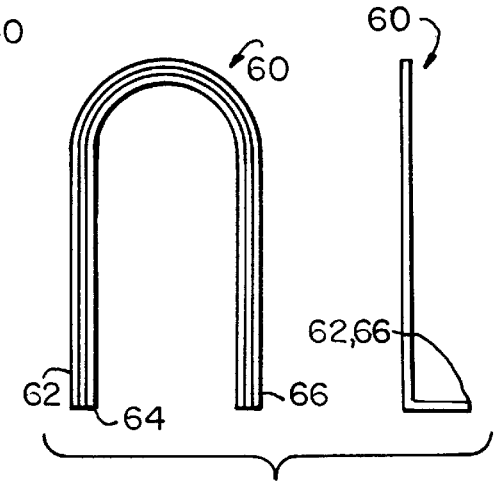
FIG. 5 shows two views of an electrical contact formed solely of carbon fibers according to an embodiment of the present invention.

As shown in FIG. 5, the planar form of a carbon fiber contact element 60 can consist of a single layer, not a matrix of carbon fiber strands, arranged in a horseshoe shape or upside-down U to provide a continuous, unbroken path from one end 62 of the carbon fiber element strands, one of which is shown typically at 64, to the other end 66, even though the carbon fiber strands may change direction by more than 90 degrees. In this embodiment each carbon fiber strand 64 will be both perpendicular and parallel to the resistive or conductive track, not shown, and each opposing end 62,66 of the continuous carbon fiber strands 64 will essentially contact different parallel resistive or conductive tracks, not shown. The horseshoe shaped contact 60 can employ a carrier, not shown, which can be electrically conductive or not, depending on the desired application.

Figure 6:
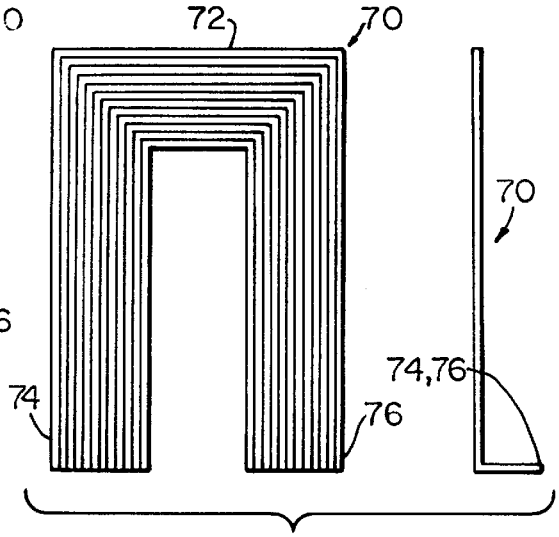
FIG. 6 shows two views of an electrical contact formed solely of carbon fibers according to another embodiment of the present invention.

A similar construction is shown in FIG. 6, wherein the contact 70 has a right-angle transition portion 72 in the path from one end 74 to the other end 76.

In the embodiment shown in FIG. 7, a contact assembly 80 has a carbon fiber element formed as a very short strip 82 firmly and conductively attached at 84 by a conductive adhesive to a parallel portion 84 of a thin beam 86 composed of electrically conductive material. This beam construction provides a means for the current or voltage signal to flow unimpeded from the resistive or conductive track to the end terminus, thereby incorporating the compatible and desirable characteristics of the carbon fiber contact material with beam members formed of materials other than carbon fiber. When this embodiment is in use, the carbon fiber element 82 will be essentially perpendicular to the plane of the resistive or conductive track at all times.

In the embodiment of the present shown in FIGS. 2A, 2B, and 2C, the planar form of the carbon fiber element consists of one or more parallel layers of carbon fiber strip arranged so that the free ends 12, 16, 20 of the carbon fiber elements 10, 14, 18, respectively, are designated as the ends that will contact the tracks of the resistive element or conductive element. It is a feature of the present invention that those ends 12, 16, 20 can be fabricated free of any other material, such as the low-resistance, synthetic resin compound or the like, for a length less than 3/16" to permit only the actual carbon fiber material to contact the respective tracks, thereby providing improved mating between the ends 12, 16, 20 of the contacts 10, 14, 18 and the tracks, not shown, of the respective conductive elements. The free end of the contact may remain parallel in the same plane or, as shown in FIGS. 2A, 2B, and 2C, the free end may be bent or formed to an angle perpendicular to the primary length of the strip or formed into a knuckle shape depending upon the application.

Figure 10:
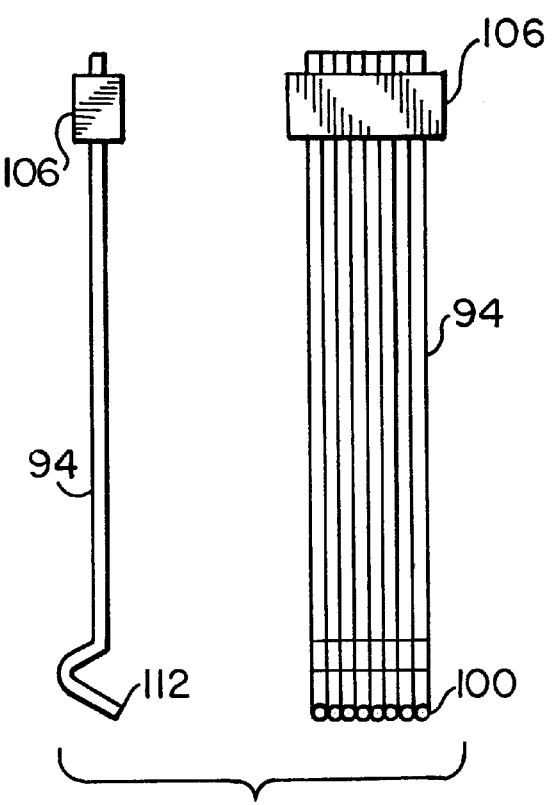
FIG. 10 shows two views of an electrical contact in which the carbon fibers are mechanically captured and chemically fused accordingly to an embodiment of the present invention.
Figure 9:
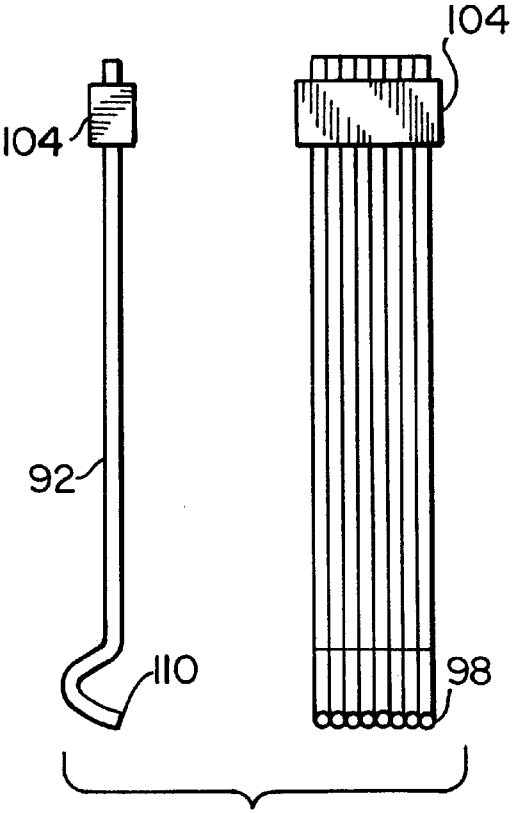
FIG. 9 shows two views of an electrical contact in which the carbon fibers are mechanically captured and chemically fused according to an embodiment of the present invention.
Figure 8:
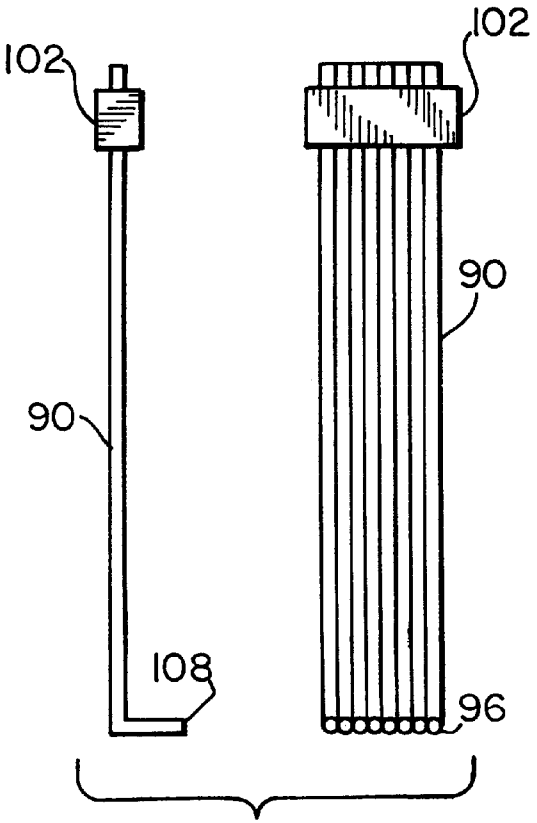
FIG. 8 shows two views of an electrical contact in which the carbon fibers are mechanically captured and chemically fused accordingly to an embodiment of the present invention.

In the embodiments shown in FIGS. 8, 9, and 10, each contact or wiper element 90, 92, 94, respectively, is fabricated in narrow strips of carbon fiber element, one of which is shown at 96, 98, 100, respectively, wherein each strip is less than 0.015 of an inch in width and is composed or one or more parallel strands of carbon fibers. A number of these strips are arranged in a single flat plane, with each strip being essentially parallel to, but not fused or chemically bonded to, each other. The multiple independent parallel strips are mechanically captured by respective collars 102, 104, 106, in a single plane and/or chemically bonded with a low-resistance, electrically conductive synthetic resin compound at one end of the assembled strips, so that the independent multiple strip sections will be electrically uniform in their output signal and also be receptive to further assembly operations.

As shown in FIGS. 8, 9, and 10, the free ends 108, 110, 112 of the respective multiple strip sections 90, 92, 94 that are to function as the intimate contact points with the track of the resistive or conductive element can remain coplanar to the strip or be formed as a rake as shown in FIG. 8, a knuckle as shown in FIG. 9, or other compatible contact geometry, such as the point as shown in FIG. 10. This feature permits the assembly to contain multiple contact strips, such as 96, 98, 100, each with relatively independent mechanical movement in a direction perpendicular to the resistive or conductive track of the substrate element.

Figure 11:
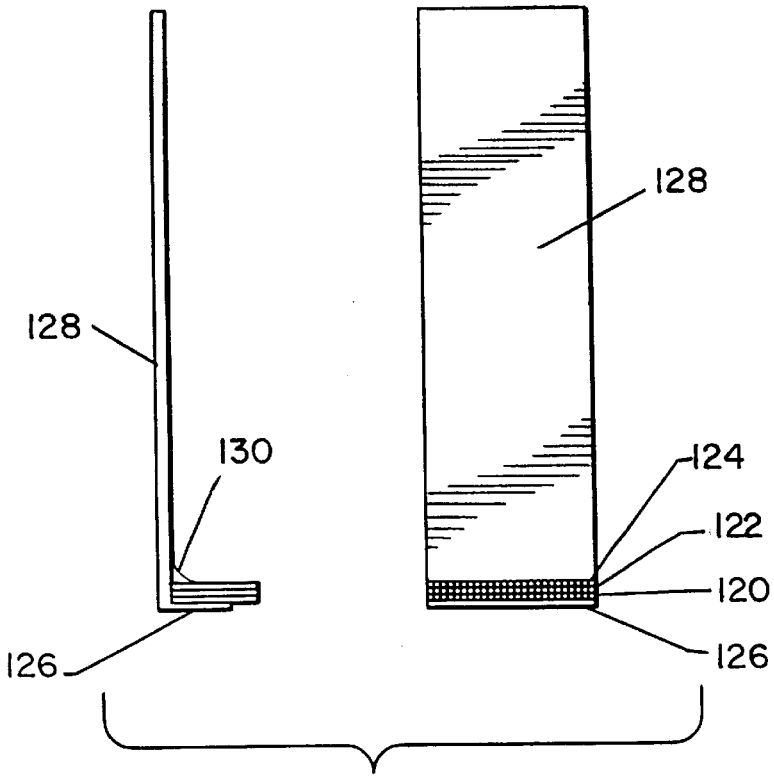
FIG. 11 shows two views of an electrical contact employing multiple layers on a carrier according to an embodiment of the present invention.

FIG. 11 is an embodiment similar to that of FIG. 7 wherein multiple layers 120, 122, 124, of carbon fiber elements are attached to a shorter leg 126 of an L-shaped carrier 128. The carbon fibers in each layer 120, 122, 124 are substantially aligned to be parallel and the layers may be attached to the carrier by an electrically conductive synthetic resin compound shown generally at 130.

As shown in the embodiments of FIGS. 3, 4, and 11, the electrical contact devices are formed of multiple layers of carbon fibers in various alignments. Similarly, all other embodiments herein shown and described can be formed of multiple layers. So too, the various embodiments of the present invention can be used with a carrier that can be electrically conductive or not, depending upon the desired application.

Figure 12:
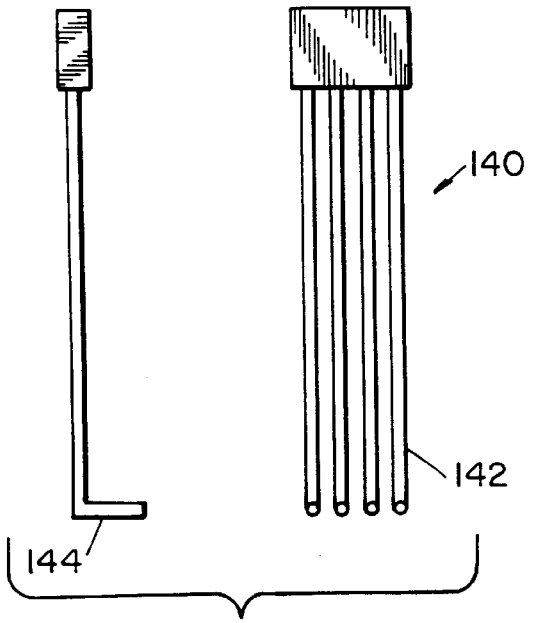
FIG. 12 shows two views of an electrical contact formed as a single carbon fiber element.

Conversely, as shown in FIG. 12, an electrical contact or wiper 140 can be formed of only a single carbon fiber element 142 that can be around 0.010 to 0.015 inches in thickness. Although a rake end 144 is provided in this embodiment, any of the other end treatments described above are also appropriate.

It is understood, of course, that the foregoing description is presented by way of example only and is not intended to limit the spirit or scope of the present invention, which is to be defined by the appended claims.

What is claimed is:

1. An electrical device for transmitting electrical signals and for movable contact with an electrically conductive track, the device comprising:

an electrical contact formed of a layer of carbon fiber bundles aligned in substantially the same direction so as to form an elongated planar structure, wherein each of said carbon fiber bundles in said layer are bonded to an adjacent one of said carbon fiber bundles and firmly fixed over substantially an entire length thereof in a resin compound, whereby free ends of said carbon fiber bundles of said layer not bonded to said adjacent carbon fiber bundles are arranged to contact the electrically conductive track; and a support strip having said electrical contact bonded thereto by a synthetic resin compound, wherein said support strip is bent so as to be L-shaped and said electrical contact is attached to a shorter arm of said L-shaped strip.

2. The electrical device according to claim 1, wherein said support strip is electrically conductive.

3. The electrical device according to claim 1, further comprising support elements arranged on either side of said layer of carbon fiber elements at an end opposite of said free ends and being set back from said free ends.

4. The electrical device according to claim 1, wherein the free ends of said layer of carbon fiber bundles are formed in a knuckle shape.

5. An electrical device for transmitting electrical signals and for movable contact with an electrically conductive track, the device comprising:

an electrical contact formed of a layer of carbon fiber bundles aligned in substantially the same direction so as to form an elongated planar structure, wherein each of said carbon fiber bundles in said layer are bonded to an adjacent one of said carbon fiber bundles and firmly fixed over substantially an entire length thereof in a resin compound, whereby free ends of said carbon fiber bundles of said layer not bonded to said adjacent carbon fiber bundles are arranged to contact the electrically conductive track, wherein the free ends of said layer of carbon fiber bundles are formed in knuckle shape.

6. An electrical device for transmitting electrical signals and for movable contact with an electrically conductive track, the device comprising:

an electrical contact formed of a layer of carbon fiber bundles aligned in substantially the same direction so as to form an elongated planar structure, wherein each of said carbon fiber bundles in said layer are bonded to an adjacent one of said carbon fiber bundles and firmly fixed over substantially an entire length thereof in a resin compound, whereby free ends of said carbon fiber bundles of said layer not bonded to said adjacent carbon fiber bundles are arranged to contact the electrically conductive track, wherein the free ends of said layer of carbon fiber elements are formed in an angularly pointed shape.

7. An electrical device for transmitting electrical signals and for moveable contact with an electrically conductive track, the device comprising:

an electrical contact formed of a layer of carbon fiber bundles each being formed of parallel strands of carbon fibers bonded together in a resin compound and said bundles being aligned in substantially the same direction so as to form an elongated planar structure; and fastening means arranged at one end of said electrical contact for holding together said layer of carbon fiber bundles and preventing relative movement there among at a holding location, whereby free ends of said bundles forming said electrical contact opposite said one end are moveable relative to one another and are arranged to contact the electrically conductive track, wherein the free ends of said layer of carbon fiber elements are formed in a knuckle shape.

8. The electrical device according to claim 7, wherein said fastening means comprises a collar for mechanically capturing said carbon fiber elements at said one end.

9. The electrical device according to claim 7, wherein said fastening means comprises an electrically conductive, synthetic resin compound for bonding together said carbon fiber elements at said one end.

10. An electrical device for transmitting electrical signals and for moveable contact with an electrically conductive track, the device comprising:

an electrical contact formed of a layer of carbon fiber bundles each being formed of parallel strands of carbon fibers bonded together in a resin compound and said bundles being aligned in substantially the same direction so as to form an elongated planar structure; and fastening means arranged at one end of said electrical contact for holding together said layer of carbon fiber bundles and preventing relative movement there among at a holding location, whereby free ends of said bundles forming said electrical contact opposite said one end are moveable relative to one another and are arranged to contact the electrically conductive track, wherein the free ends of said layer of carbon fiber elements are found in an angularly pointed shape.

11. An electrical device for transmitting electrical signals and for movable contact with electrically conductive tracks, the device comprising;

an electrical contact formed of at least one layer of carbon fiber elements bonded together and having a first arm portion, wherein the carbon fiber elements are aligned substantially in a first direction, a second arm portion spaced apart from and in a same plane as said first arm portion, wherein the carbon fiber elements are aligned substantially in the first direction, and a transition portion connecting respective first ends of said first arm portion and said second arm portion, wherein the carbon fiber elements of said transition portion are substantially aligned with each other in a second direction different from said first direction of said first and second arm portions, wherein second ends of said first and second arm portions opposite said first ends are adapted to contact said electrically conductive tracks.

12. The electrical device according to claim 11, wherein said transition portion is arranged at right angles to said first and second arm portions, so that said second direction is substantially perpendicular to said first direction.

13. The electrical device according to claim 11, wherein said transition portion is semicircular in shape and is coplanar with said first and second arm portions.

14. The electrical device according to claim 11, wherein said second ends of said first and second arm portions are formed in a knuckle shape.

15. An electrical device for transmitting electrical signals and for moveable contact with electrically conductive tracks, the device comprising:

an electrical contact formed of a plurality of overlying layers of carbon fibers formed as a matrix, wherein the carbon fibers in each layer are aligned so as to be substantially parallel and adjacent layers are aligned so that the carbon fibers therein are substantially nonparallel; and an electrically conductive synthetic resin compound binding together said carbon fibers in each layer and said plurality of overlying layers to solidify said electrical contact.

16. The electrical device according to claim 15, wherein said electrical contact is formed having a body portion and first and second arm portions extending therefrom, wherein free ends of said first and second arm portions are adapted to contact the electrically conductive tracks.

17. The electrical device according to claim 16, wherein said free ends are formed in a rake shape.

18. The electrical device according to claim 16, wherein said plurality of overlying layers are coextensive.

19. The electrical device according to claim 16, wherein said first and second arm portions are formed of a single layer of carbon fibers.

20. The electrical device according to claim 16, wherein said free ends are formed in a knuckle shape.

21. An electrical device for transmitting electrical signals and for movable contact with an electrically conductive track, the device comprising:

an electrically conductive carrier;

a plurality of layers of carbon fiber bundles, the plurality of layers being arranged in overlaying relationships and affixed on said carrier, wherein the carbon fiber bundles in each layer are aligned in substantially the same direction and bonded together and firmly fixed in a resin compound so that each layer forms a respective planar structure and free ends of the carbon fiber bundles of each layer are adapted to contact said electrically conductive track, wherein said carrier is substantially L-shaped and said plurality of layers of carbon fiber elements are affixed to a shorter leg of said L-shaped carrier.

22. The electrical device according to claim 21, wherein said plurality of layers of carbon fiber elements are affixed to said carrier using an electrically conductive, synthetic resin compound.

23. The electrical device according to claim 21, wherein said free ends are formed in a knuckle shape.

* * * * *